US005311990A

United States Patent [19]

Kalinski

[11] Patent Number: 5,311,990

[45] Date of Patent: May 17, 1994

[54] THERMOFORMED BLISTER PACKAGE HAVING QUICK DISCONNECT LOCKING COVER MECHANISM

[75] Inventor: Robert J. Kalinski, Milford, N.J.

[73] Assignee: Ethicon, Inc., Somerville, N.J.

[21] Appl. No.: 837,384

[22] Filed: Feb. 19, 1992

[51] Int. Cl.[5] ..... B65D 85/00

[52] U.S. Cl. ..... 206/370; 206/570; 220/326

[58] Field of Search ..... 206/363-370, 206/461, 467, 470, 570-572; 220/4.01, 4.21, 324, 326

[56] References Cited

U.S. PATENT DOCUMENTS

| | | | |
|---|---|---|---|
| 2,944,694 | 7/1960 | Kinsey | 220/17 |
| 3,599,826 | 8/1971 | Rocher | 220/46 |
| 3,828,969 | 8/1974 | Schurman | 220/31 S |
| 4,016,387 | 4/1977 | Aberer | 200/303 |
| 4,034,889 | 7/1977 | Hammes et al. | 220/324 |
| 4,079,880 | 3/1978 | Edwards | 229/45 R |
| 4,091,953 | 5/1978 | Daenen | 220/23.86 |
| 4,119,239 | 10/1978 | Anderson | 220/324 |
| 4,212,415 | 7/1980 | Neely | 222/231 |
| 4,216,763 | 8/1980 | Miklas | 220/4.21 |
| 4,371,092 | 2/1983 | Teague | 220/324 |
| 4,585,138 | 4/1986 | Jonkers | 220/67 |
| 4,673,100 | 6/1987 | Reis et al. | 220/324 |
| 4,684,024 | 8/1987 | Ebrahim et al. | 206/464 |
| 4,736,850 | 4/1988 | Bowman et al. | 206/570 |
| 4,782,977 | 11/1988 | Watanabe et al. | 220/324 |
| 4,917,261 | 4/1990 | Borst | 220/324 |
| 4,928,830 | 5/1990 | Brewer | 206/570 |
| 4,986,438 | 1/1991 | Borst | 220/324 |
| 5,011,020 | 4/1991 | Stevens et al. | 206/570 |
| 5,031,768 | 7/1991 | Fischer | 206/571 |

*Primary Examiner*—Jimmy G. Foster
*Attorney, Agent, or Firm*—Emil Richard Skula

[57] ABSTRACT

A thermoformed plastic package is disclosed. The package comprises a lower tray for receiving an article and a top cover. The top cover has flaps foldably connected along fold lines. The lower tray has female tabs molded into the lower trays. Inner male tabs and outer tabs are cut into in the flaps. The male tabs are engaged by the female tabs and the cover is thereby locked into place to form the assembled package. The cover is released by pulling on outer male tabs located in the flaps. The package is easily re-locked. The package optionally comprises at least one inner tray nested in the lower tray.

10 Claims, 4 Drawing Sheets

20
30
35
29
32
29
25
27
35
30
32
62
65
60
70
55
75
71
75
100
97
85
95
82
101
90
100
107
105
80

FIG-2
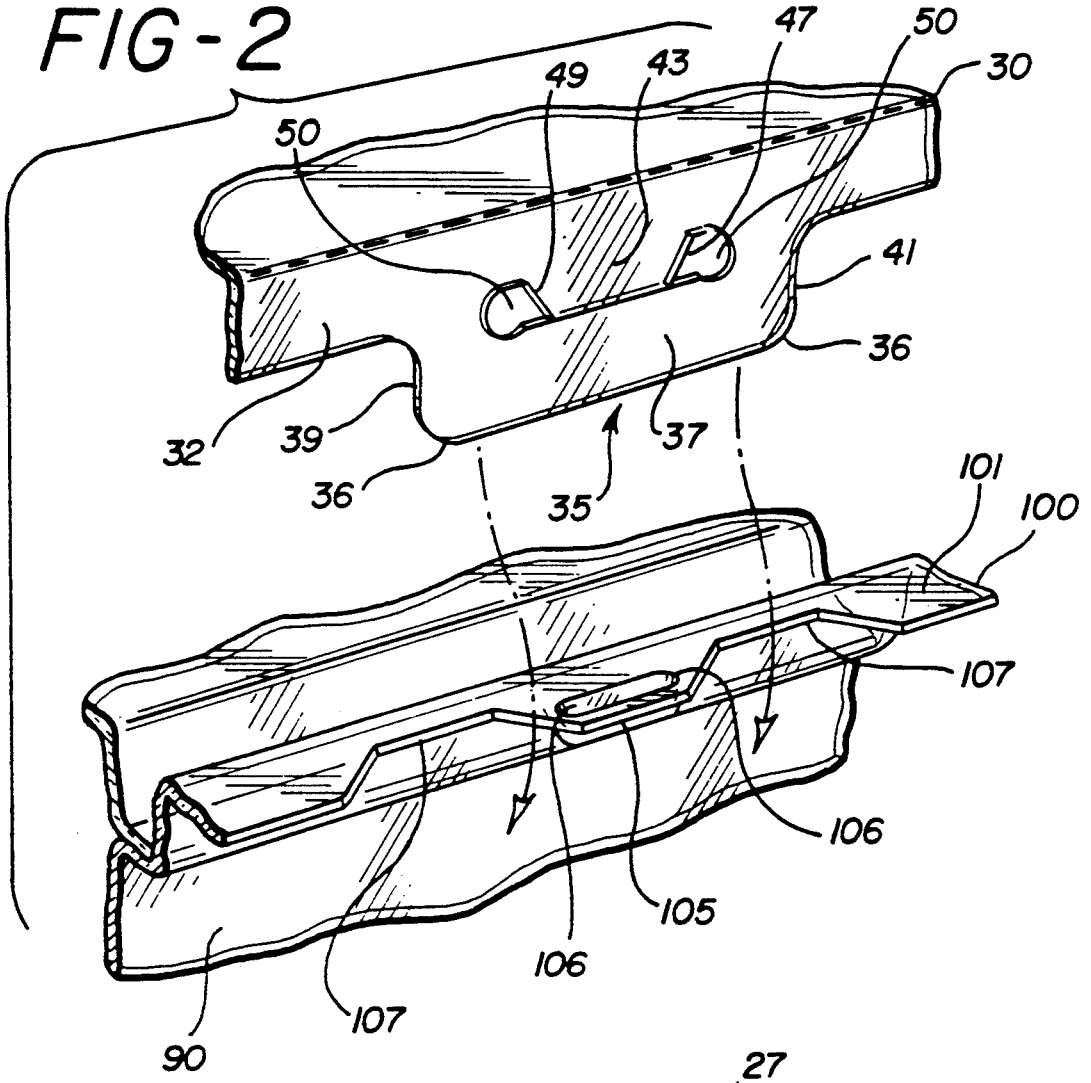
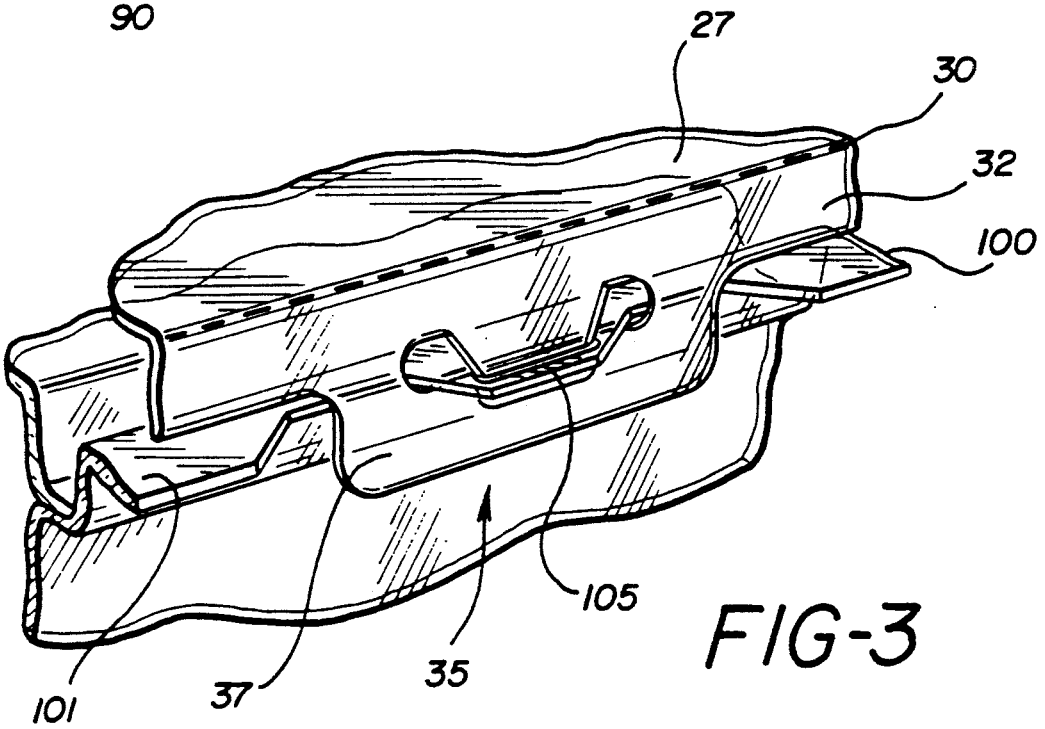
FIG-3

THERMOFORMED BLISTER PACKAGE HAVING QUICK DISCONNECT LOCKING COVER MECHANISM

The field of art to which this invention relates is packaging, in particular, thermoformed blister packaging.

BACKGROUND ART

Thermoformed blister packaging is well-known in the art. The thermoformed blister packages are manufactured using conventional thermoforming processes from conventional clear thermoplastic sheet materials. Numerous types of articles are packaged in blister packages ranging from hardware, such as nails and screws, to medical devices. Blister packaging serves multiple purposes, including holding and retaining articles, as well as allowing the observer to see what the package contains, since the thermoplastic is typically transparent. One type of blister package consists of a thermoformed tray with a non-thermoformed cover, the cover being typically made from paper or plastic. This cover is typically glued or heat bonded to the thermoformed plastic tray. In order to have access to the contents of the package, it is necessary to tear, cut or otherwise remove the cover from the package.

Another type of thermoformed plastic package is a one piece tray and cover assembly. The cover and tray are connected by what is referred to as a living hinge. In order to close this type of package, the cover, which is hinged to the lower tray, is folded, about the hinge, over and onto the lower tray in a clam shell type fashion. In order to secure the top cover to the lower tray, it is typically necessary to weld or bond flanges, extending from the upper and lower trays, to each other using an ultrasonic welding technique which is widely known in the art. Although this type of package will secure its contents, it can be very difficult to open. Typically it is necessary to cut through the welded or bonded flanges in order to access the contents of the container. It is not unusual for the contents of the package to be punctured, cut or otherwise damaged by the cutting instrument.

It is quite common to use thermoformed blister packaging for various types of medical device products. Typically a thermoformed plastic blister tray is utilized to hold the medical device, and the tray is covered with a flat cover made from either plastic or paper. The cover is typically heat sealed to a rim or flange extending from the plastic blister. There are several deficiencies associated with the use of this type of thermoformed blister package for medical devices. One disadvantage, in particular, is that the equipment needed for heat sealing is expensive and time consuming to configure, so that it is difficult to frequently change configurations of the package. Additionally, the heat sealed cover must be carefully applied so that the cover may be removed in the field simply by pulling up on the cover. Improper application of the cover may result in the cover not being openable by pulling, and having to be cut off in order to open the package. Cutting open such a package typically requires using sharp instruments which may damage the medical device contained therein. Finally, the cover of a conventional thermoformed package cannot typically be resealed in the field.

What is needed in this art are new thermoformed blister pack packages which have easily secured covers, which are easily removed by the consumer or user.

SUMMARY OF THE INVENTION

It is, therefore, an object of the present invention to provide a thermoformed blister package having a quick disconnect locking mechanism which easily locks a top cover into place and which allows easy removal, and quick disconnect of the cover.

Accordingly, a thermoformed plastic package is disclosed. The package comprises a lower tray for receiving an article, and a cover having at least one foldably connected flap along at least one side thereof. The package additionally comprises quick disconnect locking means such that when the cover is placed on top of the tray and the locking means are engaged, the cover is securely locked into place, enabling the package to endure sterilization, shipping, handling, and storage without the cover becoming disengaged from the package. However, the cover is quickly disconnected for easy access to the contents of the package by disengaging the locking means.

Another aspect of the present invention is the previously described package wherein the locking means comprise female tabs molded into the lower tray, and male tabs in at least one flap of the cover, such that the male tabs are inserted into and engaged by the female tabs, thereby locking the cover in place on top of the tray.

Yet another aspect of the present invention is quick disconnect locking means for a thermoformed blister package, wherein the package comprises a tray and a cover. The locking means comprise female tabs molded into the tray and male tabs in at least one flap of the package cover.

Other features and advantages of the invention will become more apparent from the following description and accompanying drawings.

BRIEF DESCRIPTION OF THE DRAWINGS

FIG. 2 is a perspective view of the locking means of the present invention prior to engagement.

FIG. 3 is a perspective view of the locking means of the present invention, after engagement.

BEST MODE FOR CARRYING OUT THE INVENTION

Figure 1:
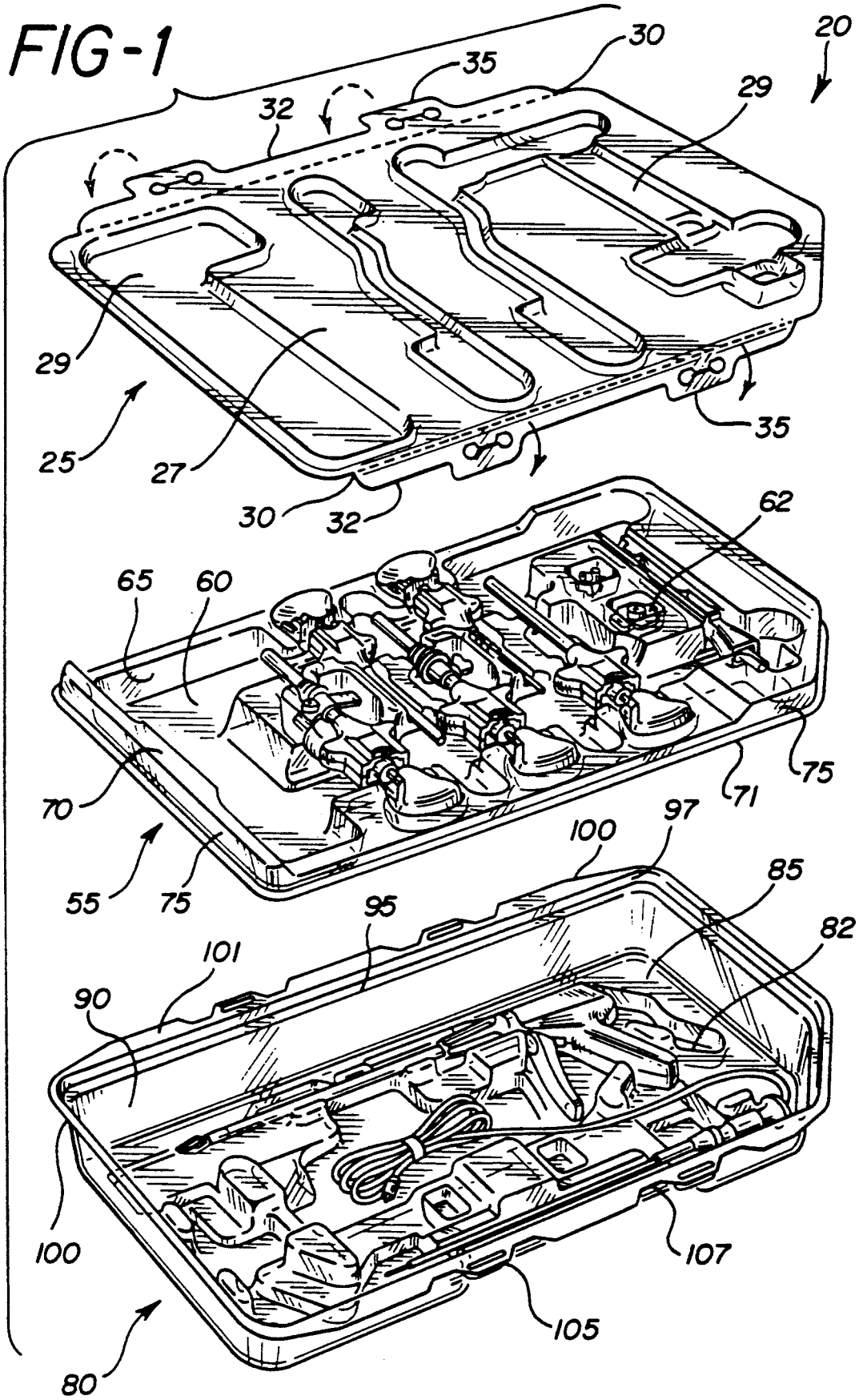
FIG. 1 is a perspective view illustrating the package of the present invention.
Figure 4:
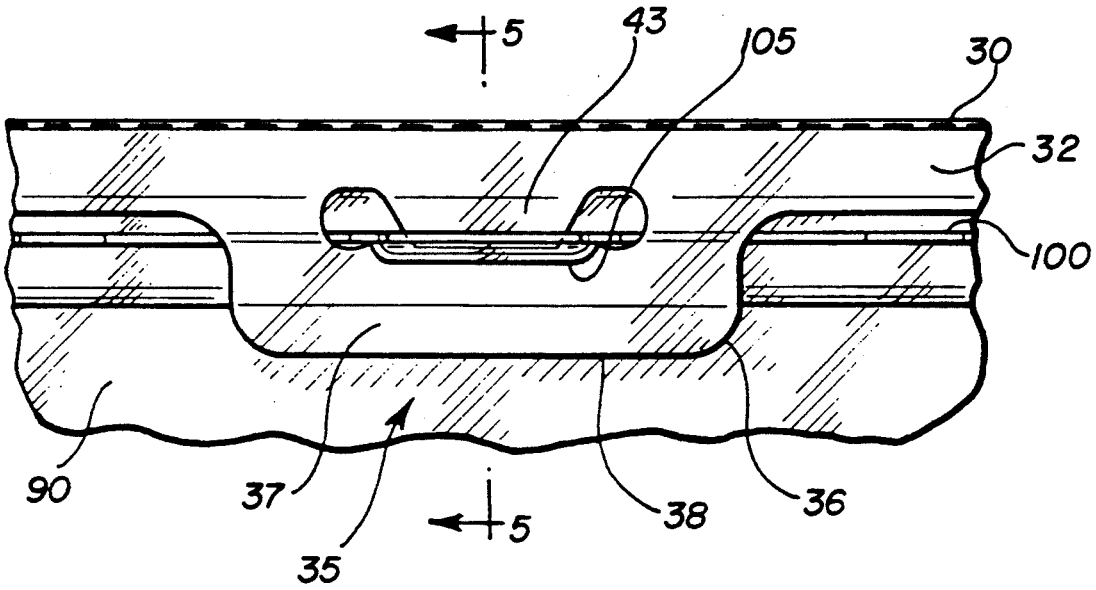
FIG. 4 is a frontal view of the locking means after engagement.
Figure 5:
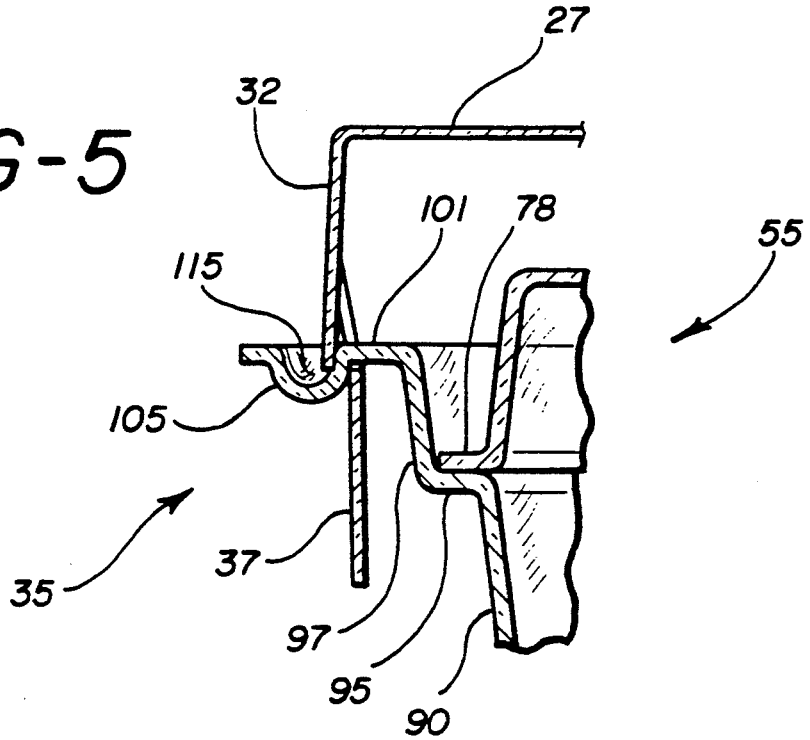
FIG. 5 is a cross-sectional view of the locking means.

Referring to FIG. 1, package 20, the thermoformed plastic blister package of the present invention, is seen to have a cover 25, a lower or bottom tray 80, and optional intermediate tray 55. Although cover 25 and bottom tray 80 may have a variety of geometrical shapes, typically the cover 25 and mating bottom tray 80 will have a substantially rectangular or square shape. Cover 25 has top 27 and flaps 32 foldably connected along fold lines 30 running along each longitudinal edge of top 27. Each fold line 30 consists of a series of perforations running through the plastic cover. Fold line 30 serves as a hinge for flap 32. Flaps 32 are foldably connected through fold line 30 to the top 27 of cover 25. Flap 32 contains tabs 35. Although it is preferred to use as a fold line 30 a score line for the foldable connection of flap 32, other types of conventional foldable connections may be used including a living hinge and a simple fold line. As can be seen in FIG. 1, cover 25 may have cavities 29 molded into top 27 which are configured to various shapes, e.g., medical devices.

Intermediate tray 55 has base 60 and continuous wall 65. Continuous wall 65 extends upwardly from base 60 of intermediate tray 55 and is substantially perpendicular thereto. The continuous wall 65 has an outwardly extending top 70 and rim 75 extending downwardly from the outer edge of top 70. Flange 71 extends outwardly from the bottom of rim 75. Base 60 may have optional cavities 62 molded therein configured to hold objects such as medical devices.

The bottom tray 80 has bottom floor 85 and a continuous outer wall 90 extending upward from bottom floor 85 to shoulder 95. Bottom tray 80 may have optional cavities 82 molded therein configured to hold various objects such as medical devices. Vertical wall 97 extends upwardly from shoulder 95 to flange 100. Flange 100 extends outwardly from vertical wall 97. Flange 100 contains female locking tabs 105.

Referring to FIG. 2, FIG. 3, FIG. 4, and FIG. 5, it can be seen that tab 105, which is molded into and extends down from flange 100, is substantially semi-cylindrical in shape with rounded ends 106, having substantially semi-cylindrical shaped cavity 115 contained therein. Although it is preferred to use a semi-cylindrical configuration for tabs 105, as will be appreciated by one skilled in the art, other geometric configurations may be used including cubic, ellipsoidal, spherical and the like. Tab 105 is molded into the flange 100 during the thermoforming process. Cavity 115 extends through the top face 101 of flange 100. Slots 107 are seen on either side of tab 105 for receiving the outer part 37 of tab 35. The slots 107 are die cut into the sheet of material used to mold bottom tray 80 and tabs 105 prior to molding.

The tab 35 is contained in flaps 32 and is typically formed by a die-cutting process. The tab 35 has optional outer tab-shaped member 37, having outer side 38, which is substantially parallel to fold line 30 and outwardly extending sides 41 and 39, which are substantially perpendicular to fold line 30. Optionally curved ends 36 connect outer side 38 with sides 39 and 41. The tab 35 also has inner tab 43, having side 45 which is substantially parallel to the fold line 30 and the outer side 38. The tab 43 also has angulated sides 47 and 49 extending from the top of the slot 50 toward the side 45. The tab 43 is formed by cutting the winged slot 50 into the flap 32.

As can be seen in FIGS. 1-5, the package 20 is assembled by initially laying optional intermediate tray 55 in the bottom tray 80 so that the flange 71 of the inner tray 55 rests on top of shoulder 95 of bottom tray 80. Then the top cover 25 is laid onto the flange 100 of the bottom tray 80 such that the male tabs 35 are in alignment with female tabs 105. The flaps 32 and the male tabs 35 are then displaced downwardly about fold lines 30 such that the inner tabs 43 of the tabs 35 are displaced into cavities 115 of the female tabs 105, and are engaged by the tabs 105, thereby locking the cover 25 to the tray 80 with sufficient tightness effective to secure the package 20. Also, the outer sides 39 and 41 of outer tab member 37 are engaged in slots 107. The cover 25 is easily removed, or quickly disconnected, from the bottom tray 80 by pulling the outer tab members 37 of the male tabs 35 in an outward manner to displace the inner tabs 43 out from the cavities 115 of the female tabs 105. After assembly of the package 20, when packaging medical devices, the package 20 is then placed into a conventional sterilization pouch, such as a plastic pouch, which is then sealed. The package 20 in the sealed pouch is then processed through a conventional sterilization process sufficient to effectively sterilize the package 20 and its contents.

Although it is preferred that the cover 25 of the package 20 of the present be a separate piece, it is possible to have an embodiment of the package 20 of the present invention wherein the cover 25 is connected to the lower tray 80. Specifically, the cover 25 may be connected to the lower tray 80 by a living hinge on one side, while the other side has the quick disconnect locking means of the present invention.

Figure 6:
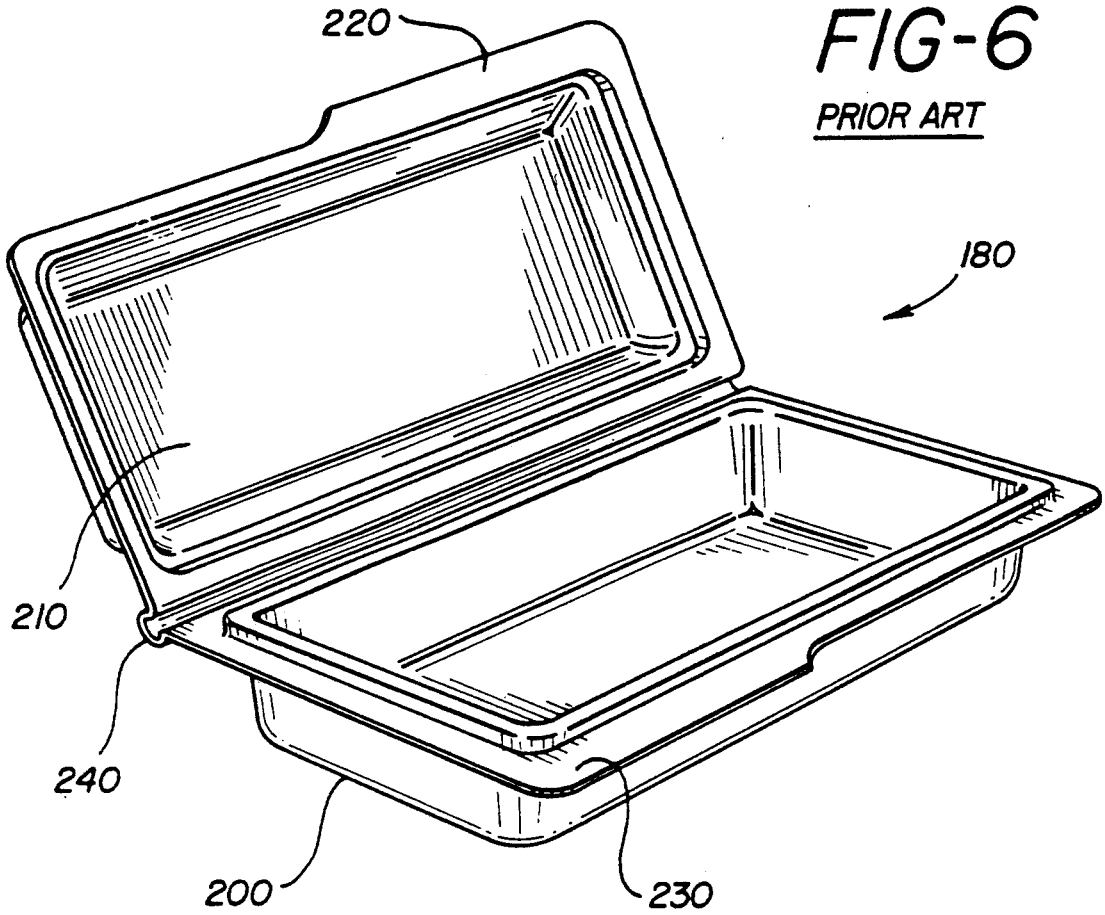
FIG-6 PRIOR ART
FIG. 6 is a perspective view of a clamshell type package having a living hinge.
Figure 7:
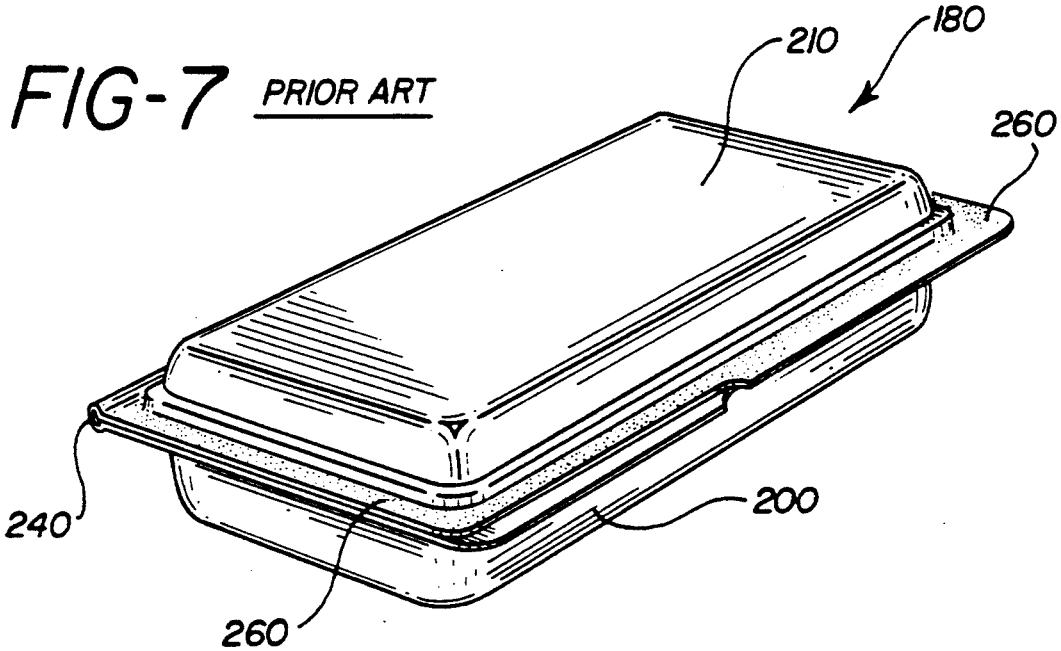
FIG-7 PRIOR ART
FIG. 7 is a perspective view of a clamshell type package after closure.

FIG. 6 AND FIG. 7 illustrate a thermoformed blister package 180 of the prior art having a living hinge 185. This clam shell-type package 180 has a lower tray 200 and an upper tray 210 and a living hinge 240. The upper and lower trays 210 and 200 are hingeably brought together to meet at the respective flanges 220 and 230 projecting outwardly from the upper tray 210 and the lower tray 200. It is necessary to bond the flanges 220 and 230 together in order to form welded flange 260 in order to secure the packages. This is typically done by ultrasonic welding, although other conventional bonding techniques may be used such as using adhesives, mechanical fasteners and the like.

In order to open this type of package, the package 180 must typically be cut open. This typically results in the package being destroyed. The package 180 is unstable during opening and the package contents are prone to accidently spill out. In addition, since sharp instruments, such as needles or knives, may be needed to open the package 180, it is not unusual for the instruments to cut or pierce the contents of the package. Damage of this type is unacceptable with medical devices since damaged medical devices are typically not useable.

In contrast to the blister packages of the prior art, the thermoformed blister package 20 of the present invention has many advantages. First of all, the thermoformed blister package 20 of the present invention eliminates the need for costly heat sealing or ultrasonic sealing. The novel blister package of the present invention is, surprisingly and unexpectedly, capable of being quickly opened via a quick release mechanism. This is particularly important in the medical device field where a medical device may be utilized for either an emergency procedure or a surgical procedure where rapid removal of the medical device from its package is critical and may be life saving. In addition, the package is completely clear, enabling the contents of the package to be visually observed and inspected in contrast to many single component thermoformed blister packages which have an opaque paper or plastic cover. The opening of a heat sealed or welded blister package where the cover has been improperly applied may necessitate the use of sharp instruments to break through the seals. This is of particular concern when packaged medical devices are being opened, since the sharp instruments may inadvertently damage the packaged medical device rendering the device unusable. In addition, the clamshell type packages 180 of the prior art are unstable during opening, frequently resulting in the contents being accidentally spilled. In contrast, the blister package 20 of the present invention is easily opened and stable, thereby preventing accidental spills.

The present invention has additional advantages. It has not been previously possible for a blister pack package to have a lid with a quick disconnect mechanism. The applicant's present invention consisting of a top 24 having a fold line 30, and, a locking mechanism consisting of male tabs 35 on the flaps 32, and, molded female tabs 105 in the flanges 100 of a lower tray 80 results in a package 20 which not only has quick release characteristics, but is able to sustain sterilization, shipping, handling, and dropping without disengagement of the top cover 25. The package 20 is easily assembled by simply placing the top cover 25 on the flanges 100 of lower tray 80 such that tabs 35 are in alignment with tabs 105. Then the tabs 35 are displaced downwardly by grasping optional tab-shaped members 37 and rotating the tabs 35 downwardly about fold line 30 so that tabs 43 are engaged in cavities 115 of tabs 105. The package 20 is similarly easily opened, that is, the cover 25 is quickly disconnected.

An additional advantage of the package 20 of the present invention is that the package can be easily reassembled after opening in the field.

The thermoformed blister packages of the present invention are formed using conventional thermoforming equipment and conventional thermoforming processes. The thermoforming process typically consists of an initial stage wherein a sheet of plastic is heated to a sufficient temperature where it is effectively moldable. Then the heated plastic sheet is placed over a mold having cavities conforming to the structure of the package. Next a vacuum is drawn through perforations in the mold to force the plastic into a configuration which conform to the contours of the mold. Next, the molded plastic sheet is cooled to a temperature above its moldable state, and the molded component is then removed from the mold.

The plastic covers 25 and lower trays 80 of the present invention are die-cut using conventional die-cutting apparatus, having cutting dies configured to produce the shape of the male tabs 35 and the slots 107. In addition, the die is configured to cut out the holes necessary to form the score line of the fold line 30 when a score line is used. Then the pieces are thermoformed by the previously-described molding techniques, although cover 25 may not be molded if it does not contain cavities 29. Likewise, bottom tray 80 may not be die-cut if it does not contain slots 107.

The plastic sheeting, which can be used to manufacture the thermoformed blister packages 20 of the present invention for use in packaging medical devices, includes suitable, conventional plastic sheeting materials known in the art and equivalents such as polyethylene terephthlate(PETE), polyvinyl chloride (PVC), polypropylene(PP) and polystyrene(PS) and the like. It is particularly preferred, when manufacturing the packages 20 of the present invention to use polyethylene terephthalate. The thickness of the sheet material is typically as thin as possible but sufficiently thick to effectively provide sufficient mechanical strength. The thicknesses will typically be about 0.010 in. to about 0.060 in., more typically about 0.060 in. to 0.35 in.

Although this invention has been shown and described with respect to detailed embodiments thereof, it will be understood with those skilled in the art and that various changes in form and detail thereof may be made without departing from the spirit and scope of the claimed invention.

What is claimed is:

1. A thermoformed plastic package comprising, a lower tray, said tray having a floor, upwardly extending sides and a flange extending outwardly from the sides, wherein the flange is substantially planar and has a top surface and a bottom surface;

a cover having at least one fold line along at least side, at least one substantially flat flap foldably connected to the cover at the fold line; and, locking means, such that when said cover is placed on top of said tray, and the locking means are engaged, the cover is securely locked into place, and the cover may be quickly disconnected for easy access to the contents of the package;

wherein said locking means comprises at least one substantially flat male tab in each flap and a flap slot in the flap adjacent to the tab;

at least one female tab molded into the flange of the lower tray, the female tab having a cavity and an opening extending through the top surface of the flange in communication with said cavity, the female cavity having a pair of opposed ends; and, a slot in the flange of the lower tray adjacent to each end of each female tab, such that when the cover is place on top of the tray with the male and female tabs in substantial alignment, and the male tab is engaged by said cavity of the female tab and the female tab is contained within the flap slot, the cover is secured and locked to the tray.

2. The package of claim 1 wherein each molded female tab comprises a semi-cylindrical member having said cavity therein.

3. The package of claim 1 further comprising at least one intermediate tray nested into the lower tray.

4. The package of claim 3 further comprising cavities molded into the intermediate tray.

5. The package of claim 1 further comprising at least one outer tab member on the outer edge of each flap for manipulating the male tab.

6. The package of claim 1 wherein the cover comprises at least two flaps and at least two fold lines.

7. The package of claim 1 wherein the fold line comprises a perforated score line.

8. The package of claim 1 wherein the cover additionally comprises molded cavities.

9. The package of claim 1 wherein the lower tray additionally comprises cavities molded therein.

10. The package of claim 1 further comprising medical devices contained therein.

* * * * *